US009451854B2

(12) United States Patent
Diminick et al.

(10) Patent No.: US 9,451,854 B2
(45) Date of Patent: Sep. 27, 2016

(54) REPOSITIONABLE FLUID SUCTION DEVICES

(76) Inventors: Anthony Scott Diminick, Hollidaysburg, PA (US); R. Douglas Evans, Jr., Everett, PA (US); Dane R. Jackson, Port Matilda, PA (US); Brian Dennis Kratzer, Huntingdon, PA (US); Matthew A. Romito, State College, PA (US)

( * ) Notice: Subject to any disclaimer, the term of this patent is extended or adjusted under 35 U.S.C. 154(b) by 274 days.

(21) Appl. No.: 13/399,490

(22) Filed: Feb. 17, 2012

(65) Prior Publication Data

US 2012/0210539 A1 Aug. 23, 2012

Related U.S. Application Data

(60) Provisional application No. 61/443,818, filed on Feb. 17, 2011.

(51) Int. Cl.
*A47L 7/00* (2006.01)
*A47L 9/06* (2006.01)

(52) U.S. Cl.
CPC ..... *A47L 7/0009* (2013.01); *A47L 9/0613* (2013.01)

(58) Field of Classification Search
CPC ..... A47L 11/34; A47L 11/4088; A47L 11/4083; A47L 11/4044
USPC ..... 15/322, 420, 415.1, 320; 604/313, 317, 604/902
See application file for complete search history.

(56) References Cited

U.S. PATENT DOCUMENTS

| | | | | |
|---|---|---|---|---|
| 2,816,664 | A | 12/1957 | Haynes | |
| 3,520,300 | A * | 7/1970 | Flower, Jr. | 604/269 |
| 3,605,171 | A * | 9/1971 | Candor et al. | 15/399 |
| 5,014,389 | A | 5/1991 | Ogilvie et al. | |
| 5,032,184 | A | 7/1991 | Ogilvie et al. | |
| 5,655,258 | A * | 8/1997 | Heintz | 15/415.1 |
| 5,720,078 | A * | 2/1998 | Heintz | 15/415.1 |
| 5,906,025 | A * | 5/1999 | Johnson | A47L 7/0014 15/415.1 |
| 6,136,098 | A * | 10/2000 | Tribastone | A47L 7/0009 134/21 |
| 6,249,932 | B1 * | 6/2001 | Chu et al. | 15/345 |
| 2010/0223748 | A1 * | 9/2010 | Lowe et al. | 15/209.1 |

* cited by examiner

*Primary Examiner* — Robert Scruggs
(74) *Attorney, Agent, or Firm* — Alan G. Towner, Esq.; Pietragallo Gordon Alfano Bosick & Raspanti, LLP

(57) ABSTRACT

A repositionable fluid suction device is disclosed. The device includes a central body and a suction channel located on an underside of the central body extending at least partially around a periphery of the central body. A rim extends downward from the central body, and may define a portion of the suction channel. A fluid collection trough extends at least partially around the periphery of the central body to collect fluids that fall on the upper surface of the central body. The outermost peripheral edge of the suction device may comprise at least one concave portion extending radially inward toward the central body.

24 Claims, 5 Drawing Sheets

REPOSITIONABLE FLUID SUCTION DEVICES

CROSS-REFERENCE TO RELATED APPLICATION

This application claims the benefit of U.S. Provisional Patent Application Ser. No. 61/443,818 filed Feb. 17, 2011, which is incorporated herein by reference.

FIELD OF THE INVENTION

The present invention relates to repositionable fluid suction devices useful for collecting and removing spilled fluids from floors and other surfaces.

BACKGROUND INFORMATION

Various devices are known for removing fluids from floors and other surfaces. For example, during surgical operations, fluids may be spilled onto the floor of the operating room and must be collected and discarded. Examples of such devices are described in U.S. Pat. Nos. 5,014,389; 5,032,184; 5,906,025; 5,655,258; 5,720,078; and 6,136,098.

Despite such devices, a need still exists for improved repositionable fluid suction devices that effectively and efficiently collect and remove fluids from operating floors and other types of floors and horizontal surfaces.

SUMMARY OF THE INVENTION

An aspect of the present invention is to provide a fluid suction device comprising a central body, a suction channel located on an underside of the central body extending at least partially around a periphery of the central body, and an extended member extending downward from the central body adjacent to the suction channel.

Another aspect of the present invention is to provide a fluid suction device comprising a central body, a suction channel located on an underside of the central body extending at least partially around a periphery of the central body, and a drain trough extending at least partially around the periphery of the central body in fluid flow communication with an upper surface of the central body.

A further aspect of the present invention is to provide a fluid suction device comprising a central body, a suction channel located on an underside of the central body extending at least partially around a periphery of the central body, and an outermost peripheral edge comprising at least one concave portion extending radially inward toward the central body.

These and other aspects of the present invention will be more apparent from the following description.

DETAILED DESCRIPTION

Figure 1:
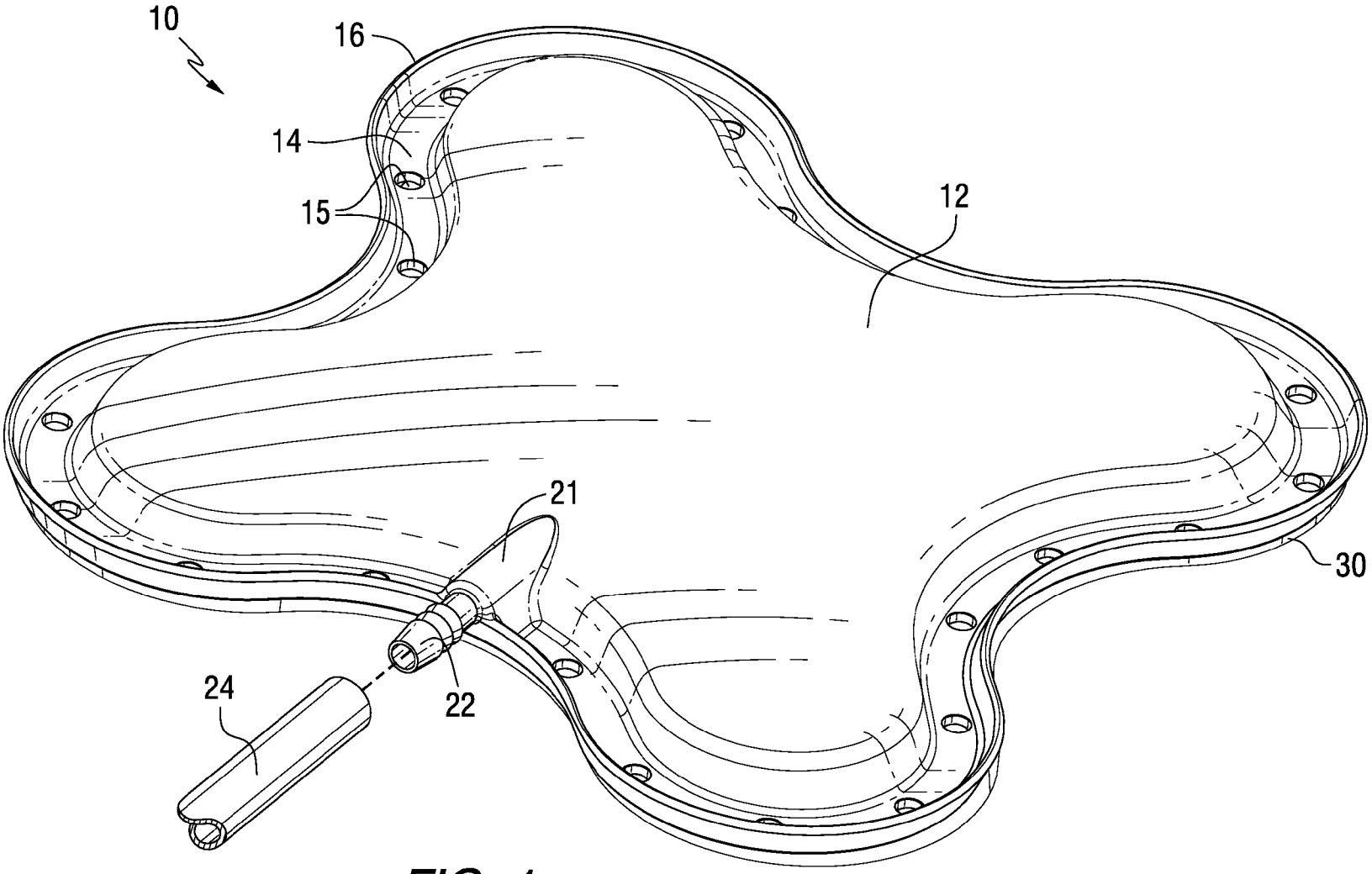
FIG. 1 is an isometric view of a fluid suction device in accordance with an embodiment of the present invention.
Figure 2:
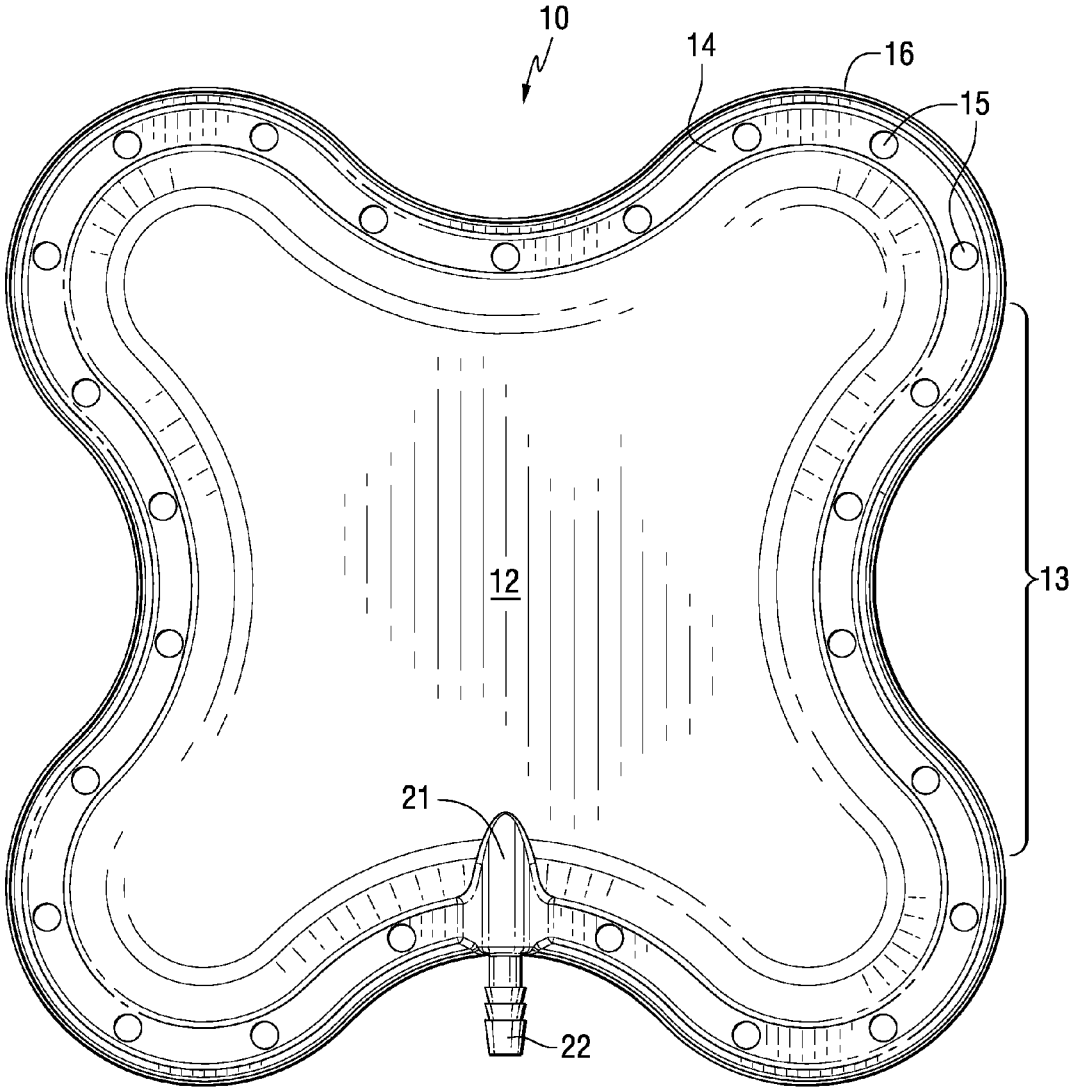
FIG. 2 is a top view of the fluid suction device of FIG. 1.

FIGS. 1-4 illustrate a fluid suction device 10 in accordance with an embodiment of the present invention. The fluid suction device 10 includes a central body 12, a drain trough 14 and an outer raised lip 16. Drain holes 15 are provided through the bottom of the drain trough 14. As shown most clearly in FIGS. 3 and 4, an extended rim 18 projects downwardly inside the central body 12, and a bottom surface 19 extends toward the outer edge of the device adjacent to the raised lip 16. In the embodiment shown, the bottom surface 19 is flat and extends radially outward in a horizontal direction from the extended rim 18. The drain trough 14 extends around the periphery of the central body 12, and the drain holes 15 allow fluid collected in the drain trough 14 to pass to the bottom surface 19. The central body 12 has a convex upper surface, or any other suitable shape, that directs fluid toward the lower drain trough 14. The central body 12 may be made of any suitable material such as polymers or metals, e.g., injection molded plastic.

Figure 3:
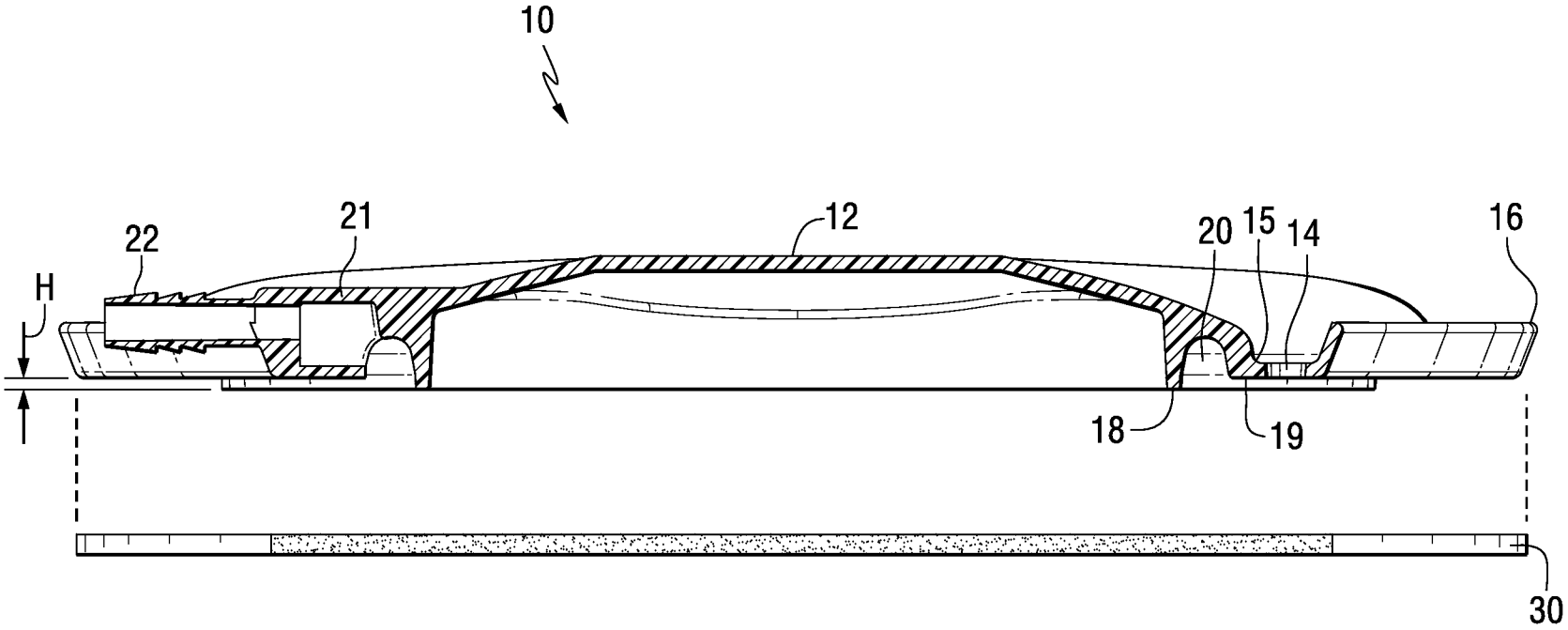
FIG. 3 is a cross-sectional exploded side view of the fluid suction device of FIG. 1, illustrating an upper body of the device and a fabric pad that may be secured to the underside of the device.

As shown in FIG. 3, the extended rim 18 extends downwardly below the bottom surface 19. The bottom surface 19 is located at a vertical height H above a bottom edge of the extended rim 18. The height H is typically from 0.02 to 0.2 inch, for example, from 0.06 to 0.08 inch. The height H may be selected based upon the wet thickness of a fabric pad 30 mounted on the underside of the fluid suction device 10, as more fully described below.

The raised lip 16 defines an outermost peripheral edge of the suction device 10. In the embodiment shown, the raised lip 16 extends at an angle upward and radially outward from the bottom surface 19 of the suction device 10. The raised lip 16 thus forms part of the drain trough 14 extending around the periphery of the central body 12. The raised lip 16 typically has a height of from 0.1 to 0.5 inch, e.g., about 0.2 inch.

Figure 4:
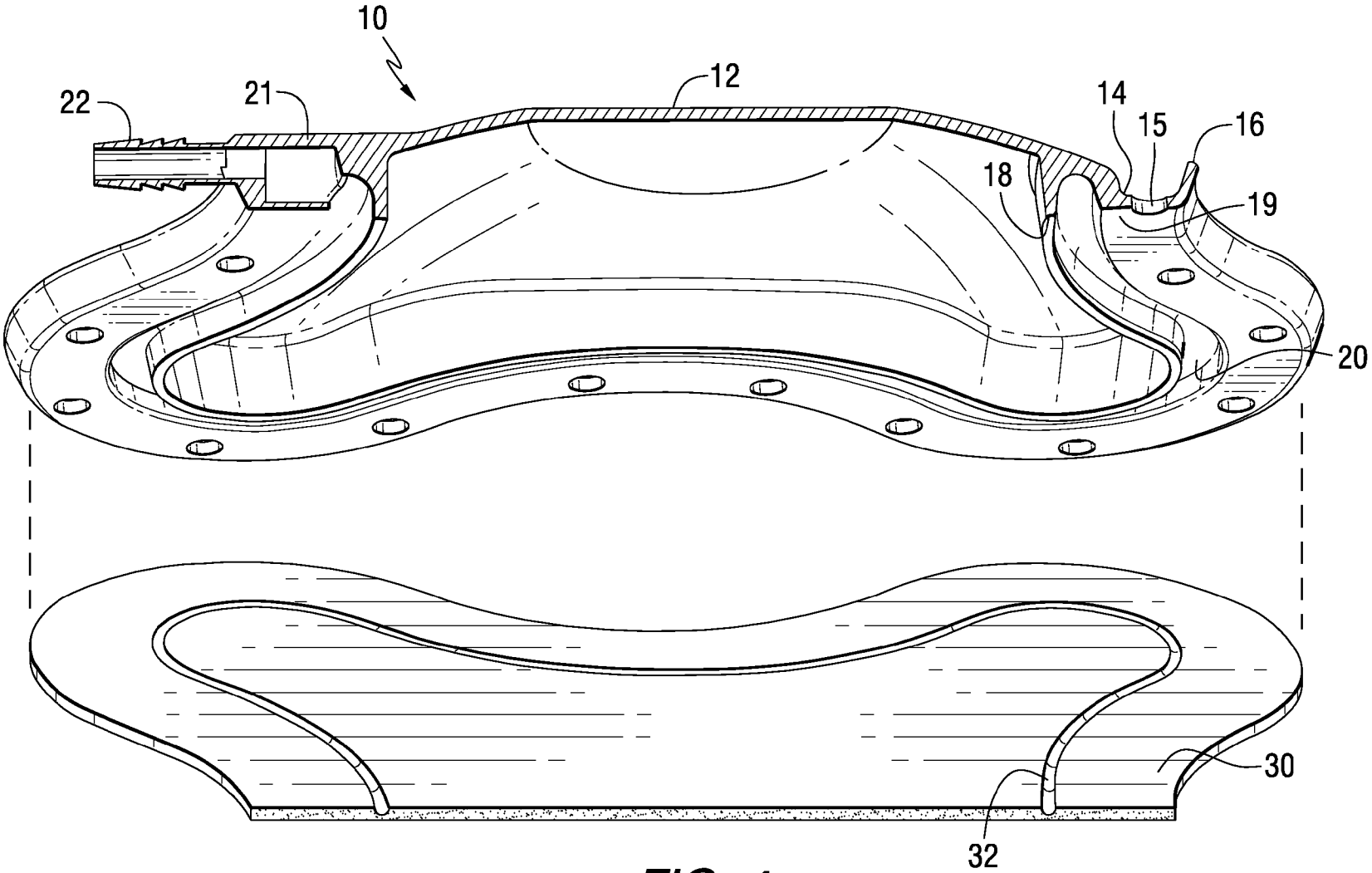
FIG. 4 is a cross-sectional isometric bottom view of the fluid suction device of FIG. 1.

As shown most clearly in FIGS. 3 and 4, a suction channel 20 is located radially between the extended rim 18 and the bottom surface 19. In the embodiment shown, the suction channel 20 extends continuously around the periphery of the central body 12. Alternatively, the suction channel may be discontinuous. A vacuum manifold 21 and vacuum fitting 22 are provided in the central body 12 in communication with the suction channel 20. As shown in FIGS. 3 and 4, the interior volume of the vacuum manifold 21 communicates with the suction channel 20 through a sidewall of the suction channel 20. The drain trough 14 forms a bottom wall of the vacuum manifold 21 in FIGS. 3 and 4. However, the portion of the trough 14 under the vacuum manifold 21 may be removed in order to facilitate fabrication of the device, e.g., to avoid a closed cavity during molding operations. As shown in FIG. 1, a vacuum tube 24 may be connected to the vacuum fitting 22.

The suction channel 20 forms a channel or a series of floor-facing openings for suctioning and transferring fluids to an external vessel (not shown). In the embodiment shown, the suction channel 20 comprises closed top and side walls, and an open bottom portion. The suction channel 20 typically has a cross-sectional width of from 0.06 to 1.5 inch, and a cross-sectional height of from 0.12 to 1.5 inch. In certain embodiments, the cross-sectional width of the suction channel is from 0.1 to 1 inch, and the cross-sectional height is from 0.2 to 1 inch.

In the embodiment shown, the extended rim 18 extends around the periphery of the central body 12 and defines a side wall of the suction channel 20. The extended rim 18 and the suction channel 20 are thus coextensive around the periphery of the central body 12. The extended rim 18 has a load bearing bottom edge that supports the weight of the central body 12. The bottom edge of the extended rim 18 lies in a horizontal plane and is structured to directly or indirectly contact a horizontal surface during operation of the suction device 10.

A pad 30 is secured to the bottom of the fluid suction device 10. In the embodiment shown, the pad 30 covers substantially the entire underside of the central body 12. However, the pad 30 may only cover a portion of the underside in certain embodiments. For example, the pad 30 may cover the suction channel 20 and the bottom edge of the extended rim 18. The bottom edge of the extended rim 18 limits the floor-contacting area of the device for easier sliding movement across the floor, and to prevent the portion of the pad 30 that is under the bottom surface 19 from being fully compressed by the downward suction force on the device.

FIG. 4 shows a compressed area 32 in the pad 30 caused by pressure exerted by the extended rim 18 on the pad 30 during use. The extended rim 18, while compressing the pad beneath it, prevents the pad beneath the drain trough 14 and bottom surface 19 from being compressed and restricting fluid flow therethrough. Thus, as a fluid puddle contacts the non-compressed pad 30, the fluid is quickly drawn toward the suction channel 20 where it is collected and removed from the device. The compressed area of the pad 32 beneath the extended rim 18 also creates a seal so that the suction is directed outward toward the edge of the device rather than inward where there may be no spilled fluid. This results in more efficient fluid removal.

The pad 30 has a typical thickness of from 0.06 to 0.5 inch, for example, from 0.1 to 0.3 inch. The pad 30 may be permanently or temporarily secured to the central body 12 by any suitable adhesive or other securement means, such as mechanical fasteners, hook and loop fasteners, and the like. In certain embodiments, the pad 30 may be disposable.

In certain embodiments, the pad comprises a woven or nonwoven fabric, for example, comprising cellulose and/or synthetic fibers. In a particular embodiment, the pad 30 is a woven or nonwoven fabric with a weight of 4 to 12 ounce per square yard (osy), e.g., 6 to 10 osy. The pad 30 may comprise a cellulose based airlaid nonwoven material with a surface comprising from 20 to 100 percent synthetic fibers, typically from 50 to 75 or 85 percent synthetic fibers. The synthetic fibers may be polyester, polypropylene, polyethylene, nylon or combinations thereof. The fibers may also be heat activated bonding fibers. The cellulose portion of the airlaid material may collapse when wet to restrict free air flow into the suction channel 20, thus reducing noise but still allowing quick fluid uptake. Also, when the device is moved along the floor, the cellulose portion may wipe up the majority of the fluid, leaving the surface substantially dry, i.e., excellent wipe-dry properties. The synthetic portion of the airlaid material may glide over floors easier than cellulose, but may have reduced wipe-dry properties. Accordingly, the synthetic portion may comprise the majority of the surface fibers in certain embodiments.

The shape or footprint of the fluid suction device can be any geometric shape such as a rectangle, circle, oval or a combination of shapes. Preferably, as shown most clearly in FIG. 2, the shape or footprint of the fluid suction device 10 is such that it includes at least one concave fluid-channeling side 13 that facilitates fluid collection. The concave edge 13 directs fluid toward the centerline of device for collection as the device is moved along a floor.

Figure 5:
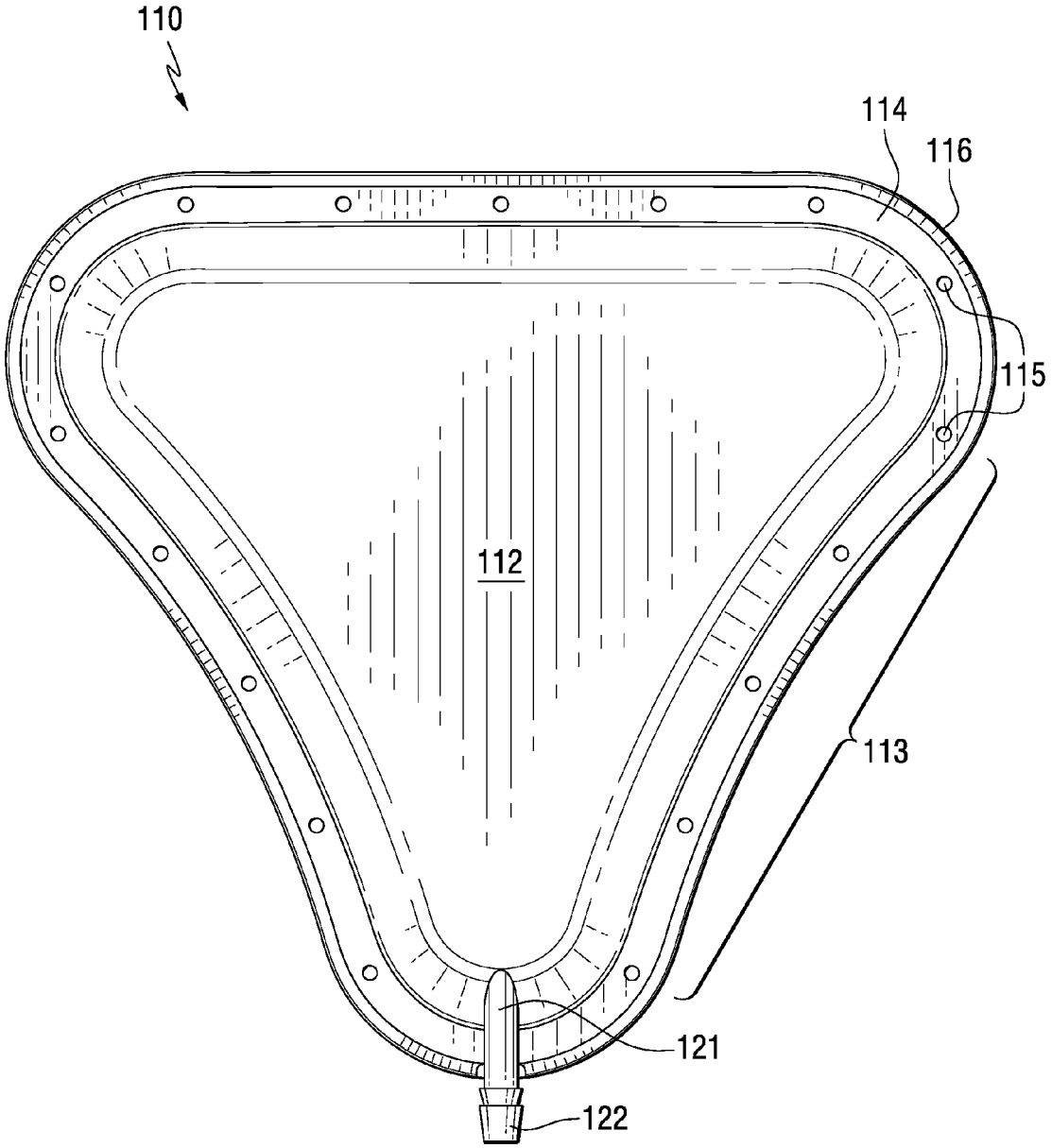
FIG. 5 is a top view of a fluid suction device in accordance with another embodiment of the present invention.

FIG. 5 illustrates a fluid suction device 110 in accordance with another embodiment of the present invention. The fluid suction device 110 has similar features as the embodiment shown in FIGS. 1-4, and includes a central body 112, drain trough 114, drain holes 115 and raised lip 116. In the embodiment of FIG. 5, the central body 112 of the fluid suction device 110 has a shape or footprint including two concave fluid-channeling sides 113 that facilitate fluid collection. A vacuum manifold 121 and vacuum fitting 122 extend from the suction channel (not shown) and are connected to any suitable vacuum source (not shown).

The fluid suction devices of the present invention may be used to remove fluids from floors and other horizontal surfaces. The devices may be connected to any suitable negative pressure source to transport collected fluid to an external receiving vessel. An external suction source (not shown) capable of creating a negative pressure of, for example, 5 to 30 inches of mercury, may be connected to the suction devices of the present invention. The external suction source typically has a fluid receiving chamber (not shown) to collect fluid drawn in by the suction.

The fluid suction devices can be located directly beneath a fluid stream for collection before the fluid reaches the floor, or may be placed in a pooled area of the spilled fluid. The devices may be moved around the floor to different wet areas by pushing them by foot or with a separate long handle (not shown), or pulling them by the attached suction tubing. The suction devices may thus be placed on a floor where it is expected that fluid will fall from above, or where fluid will collect, such as in a low spot of the floor. When fluid impinges the device from above, the sloped sides of the central body direct the fluid into the drain trough and the outer wall of the trough keeps the fluid from sloshing out. The fluid in the trough drains through the bottom holes into the fabric pad below. As the fabric pad becomes saturated, the fluid wicks laterally, aided by the applied suction, toward the suction channel. The fluid is then drawn into the suction channel and flows under negative pressure to exit the device through the suction connection tube.

The fluid suction devices may have a low profile to reduce trip hazards. The upper surface of the body may have a surface texture or protrusions that increase the device-to-foot traction for sliding the device by foot. An external suction vent hole (not shown) extending into the central volume of the body may be provided in order to relieve any leakage of suction into the central volume.

The fluid suction devices of the present invention possess several advantages. The drain trough collects fluid that impinges the top of the device and funnels it to the small-pore fabric or other pad material for removal by the suction channel. Thus, fluid that impinges the top surface may be suctioned away before it reaches the floor. The concave or serpentine outer peripheral edges provide a footprint that directs fluid inward toward the device for collection when the device is pushed or pulled through a spilled fluid. Otherwise, a flat or convex edge may plow through a spilled fluid and divert the fluid away from the collection device. The angled shape of the raised lip forming a portion of the trough wall permits a user to step or press on the wall, which then may tip the device slightly off the floor to break suction contact with the floor. The suction device may then be easier to slide because the suction force does not draw the device down onto the floor.

Whereas particular embodiments of this invention have been described above for purposes of illustration, it will be evident to those skilled in the art that numerous variations of the details of the present invention may be made without departing from the invention.

The invention claimed is:

1. A fluid suction device comprising:

a central body;

a suction channel located on an underside of the central body extending at least partially around a periphery of the central body;

an extended member extending downward from the central body adjacent to the suction channel comprising a rim extending at least partially around the periphery of the central body forming a portion of the suction channel, wherein the rim of the extended member comprises a load bearing bottom edge of the central body, the rim of the extended member and the suction channel are integrally formed of a rigid material, and the rim of the extended member and the suction channel are substantially coextensive around the periphery of the central body; and a raised bottom surface extending radially outward from the rim of the extended member and located at a vertical height H above a bottom edge of the rim of the extended member, wherein the suction channel is located radially between the rim of the extended member and the raised bottom surface and the suction channel terminates at the raised bottom surface.

2. The fluid suction device of claim 1, further comprising a pad mounted on the underside of the central body in contact with the bottom edge of the rim of the extended member.

3. The fluid suction device of claim 1, wherein the raised bottom surface is substantially flat.

4. The fluid suction device of claim 1, wherein the height H is from 0.02 to 0.2 inch.

5. The fluid suction device of claim 1, further comprising a pad mounted on the bottom surface.

6. The fluid suction device of claim 5, wherein the pad comprises a woven or nonwoven fabric comprising cellulose and synthetic fibers.

7. The fluid suction device of claim 5, wherein the pad is secured to the bottom surface by an adhesive.

8. The fluid suction device of claim 5, wherein the pad is permanently secured to the bottom surface.

9. The fluid suction device of claim 5, wherein the pad is removably secured to the bottom surface and is disposable.

10. The fluid suction device of claim 1, further comprising a drain trough located vertically above the bottom surface.

11. The fluid suction device of claim 10, further comprising at least one drain hole communicating between the drain trough and the bottom surface.

12. The fluid suction device of claim 1, further comprising at least one fluid collection area in fluid flow communication with an upper surface of the central body.

13. The fluid suction device of claim 12, wherein the fluid collection area comprises a drain trough extending at least partially around the periphery of the central body.

14. The fluid suction device of claim 13, wherein the drain trough comprises at least one drain hole in fluid flow communication with the underside of the central body.

15. The fluid suction device of claim 1, further comprising a raised lip defining an outermost peripheral edge of the fluid suction device.

16. The fluid suction device of claim 15, wherein the raised lip extends at an angle upward and radially outward from a bottom surface of the fluid suction device and forms a side wall of a drain trough extending around the periphery of the central body.

17. The fluid suction device of claim 1, wherein the suction channel comprises closed top and side walls and an open bottom portion.

18. The fluid suction device of claim 17, wherein the suction channel has a cross-sectional width of from 0.06 to 1.5 inch, and a cross-sectional height of from 0.12 to 1.5 inch.

19. The fluid suction device of claim 1, further comprising a pad mounted on a bottom surface of the device.

20. The fluid suction device of claim 19, wherein the pad covers substantially the entire bottom surface of the device.

21. The fluid suction device of claim 19, wherein the pad covers a portion of the bottom surface of the device including the suction channel.

22. The fluid suction device of claim 19, wherein the pad comprises a woven or nonwoven fabric comprising cellulose and synthetic fibers.

23. The fluid suction device of claim 19, wherein the pad has a thickness of from 0.06 to 0.5 inch.

24. The fluid suction device of claim 1, wherein the fluid suction device has an outermost peripheral edge comprising at least one concave portion extending radially inward toward the central body.

* * * * *